US005100339A

United States Patent [19]

Sato et al.

[11] Patent Number: 5,100,339

[45] Date of Patent: Mar. 31, 1992

[54] ELECTRICAL CONNECTOR STRUCTURE

[75] Inventors: Kensaku Sato; Akira Shirai, both of Tokyo, Japan

[73] Assignee: Hirose Electric Co., Ltd., Tokyo, Japan

[21] Appl. No.: 698,105

[22] Filed: May 10, 1991

[30] Foreign Application Priority Data

Jul. 16, 1990 [JP] Japan ..... 2-74340[U]

[51] Int. Cl.[5] ..... H01R 13/627

[52] U.S. Cl. ..... 439/354; 439/358

[58] Field of Search ..... 439/344, 350, 352, 354, 439/355, 357, 358, 676

[56] References Cited

U.S. PATENT DOCUMENTS 4,222,624 9/1990 Eme et al. ..... 439/350
4,272,145 6/1981 LaDuke ..... 439/358
4,640,566 2/1987 Matsusaka ..... 439/350
4,941,839 7/1990 Nagasaka ..... 439/358

*Primary Examiner*—Larry I. Schwartz
*Assistant Examiner*—Hien D. Vu
*Attorney, Agent, or Firm*—Kanesaka & Takeuchi

[57] ABSTRACT

An electrical connector structure (1) includes a connector socket (2) having a plug receiving opening (4) and a lock recess (5); a connector plug (3) having a plug block (13) to be fitted into the plug receiving opening for making electrical connection; a lock mechanism (14) provided on a front surface (13*a*) of the connector plug for engagement with the lock recess for assuring the connection; the lock mechanism including a lock arm (15) with its free end (15*a*) having a slit (17); and a key member (20) extending into the slit from the front surface of the plug block.

2 Claims, 4 Drawing Sheets

ELECTRICAL CONNECTOR STRUCTURE

BACKGROUND OF THE INVENTION

1. Field of the Invention

The present invention relates to electrical connector structures for use in electronic equipment.

2. Description of the Prior Art

In conventional electrical connectors, a connector plug is fitted into the plug receiving opening of a connector socket for making electrical connection while the lock mechanism of the connector plug is fitted into the recess of the connector socket for assuring the connection.

FIG. 11 shows a conventional lock mechanism which includes a plug body b and a lock arm a extending downwardly from the upper front surface of the plug body b. The lock arm a is provided with a pair of engaging projections c and d on opposite sides of a middle portion thereof for engagement with a connector socket.

A pair of key members e and f are provided on the lower front surface of the plug body b on opposite sides of the lock arm a for preventing a cable g from being caught between the lock arm a and the front surface of the plug body b.

However, the key members e and f make the structure of receiving opening of a connector socket complicated and less compact.

SUMMARY OF THE INVENTION

Accordingly, it is object of the invention to provide an electrical connector structure having a simple and compact lock structure.

According to the invention there is provided an electrical connector structure which includes a connector socket having a plug receiving opening and a lock recess; a connector plug having a plug block to be fitted into the plug receiving opening for making electrical connection; a lock mechanism provided on a front surface of the connector plug for engagement with the lock recess for assuring the connection; the lock mechanism including a lock arm with its free end having a slit; and a key member extending into the slit from the front surface of the plug block.

With the lock structure according to the invention it is possible to reduce the number of key members from two to one. In addition, this single key member is placed within the slit so that the structure of a plug receiving opening is simple and compact.

The above and other objects, features, and advantages of the invention will be more apparent from the following description when taken in conjunction with the accompanying drawings.

DESCRIPTION OF THE PREFERRED EMBODIMENT

Figure 1:
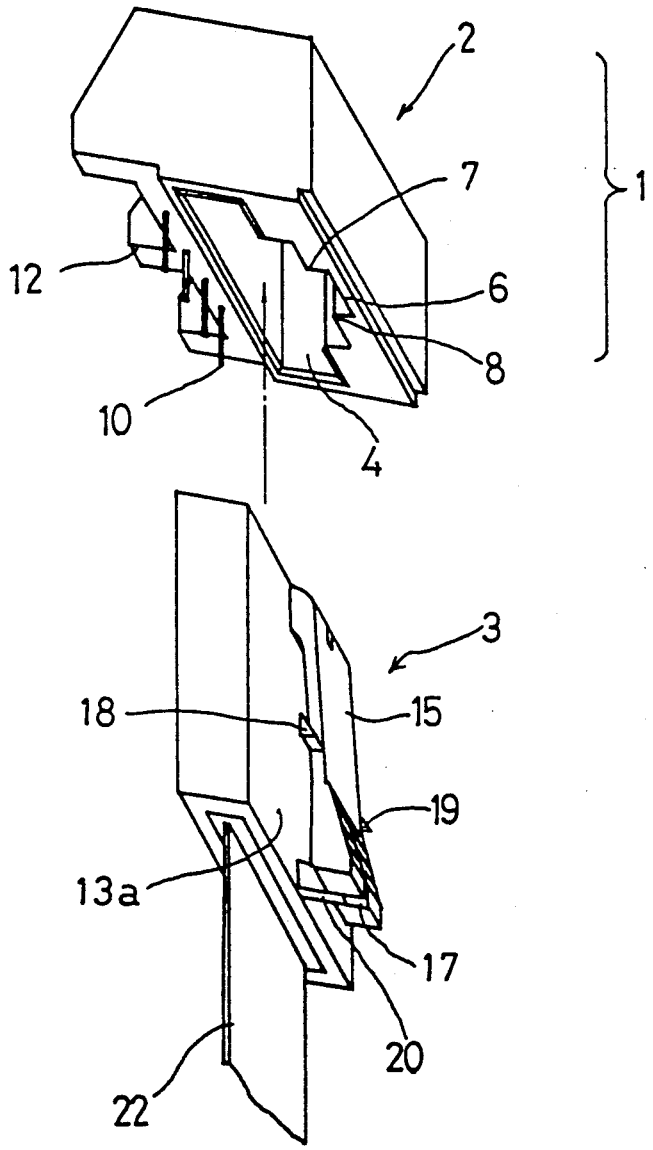
FIG. 1 is an exploded perspective view of an electrical connector structure according to an embodiment of the invention.
Figure 2:
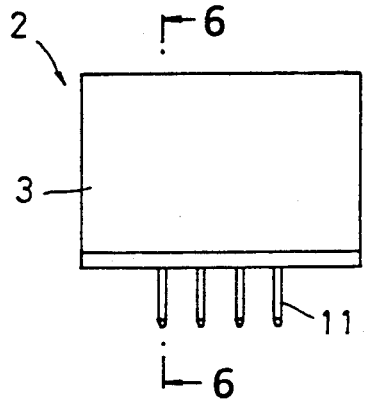
FIG. 2 is a front elevational view of a connector socket of FIG. 1.
Figure 3:
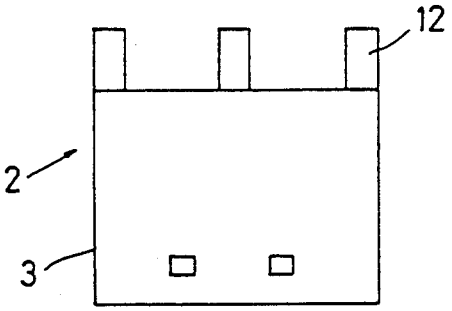
FIG. 3 is a top plan view of the connector socket of FIG. 2.
Figure 4:
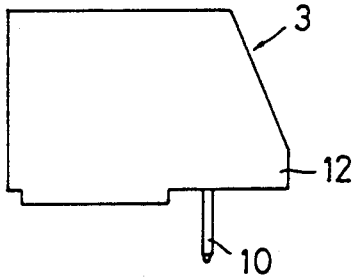
FIG. 4 is a side elevational view of the connector socket of FIG. 2.
Figure 5:
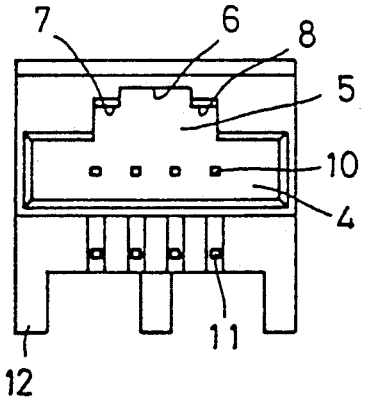
FIG. 5 is a bottom plan view of the connector socket of FIG. 2.

In FIG. 1, an electrical connector structure 1 includes a connector socket 2 to be mounted on a board and a connector plug 3 to be plugged into the connector socket 2.

In FIGS. 2-6, the connector socket 2 includes a socket block 3 which is made from a synthetic resin so as to have a plug receiving opening 4 extending upwardly from the bottom 3*a*. The plug receiving opening 4 is provided lock recess 5 adjacent the front wall 3*b* of the socket block 3. The lock recess 5 is provided with a lock arm receiving recess 6 and a pair of engaging shoulders 7 and 8 across the lock arm receiving recess 6. Four terminals 9 are embedded in the rear wall 3*c* of the socket block 3. Contact sections 10 of the terminals 9 project downwardly from the end face 4*a* into the plug receiving opening 4. Leg portions 11 of the terminals 9 project downwardly from the bottom 3*a* of the socket block 3. Three ribs 12 are formed integrally with the rear wall 3*c* of the socket block 3 for preventing the connector socket 2 from falling.

In FIGS. 7-10, the connector plug 3 includes a have a lock mechanism 14 on its front surface 13*a*. The lock mechanism 14 includes a lock arm 15 extending downwardly from the upper central portion of the front surface 13*a*. The lock arm 15 has a thicker free end portion 15*a* with the top face 16 corrugated for prevent slippage when depressed. The free end portion 15*a* has a slit 17 extending upwardly from the end face 15*b*. A pair of engaging projections 18 and 19 with a sloped top face are provided on opposite sides of a middle portion of the lock arm 15. A key member 20 extend into the slit 17 from the lower center of the front surface 13*a*. Four contact terminals 21 are placed within the plug block 13 and connected to a cable 22 (FIG. 1).

Figure 6:
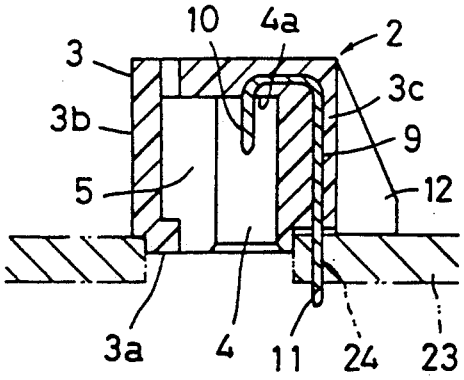
FIG. 6 is a sectional view taken along line 6—6 of FIG. 2.
Figure 7:
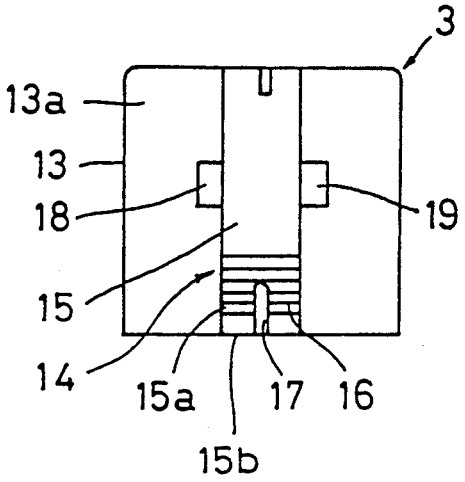
FIG. 7 is a front elevational view of a connector plug of FIG. 1.
Figure 8:
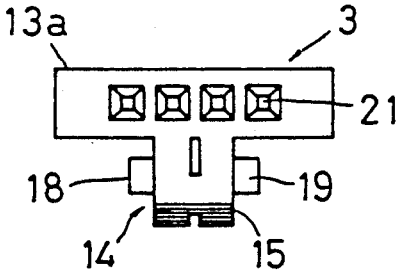
FIG. 8 is a top plan view of the connector plug of FIG. 7.
Figure 9:
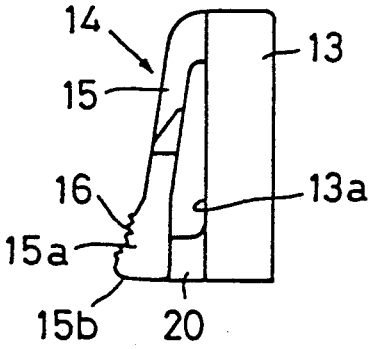
FIG. 9 is a side elevational view of the connector plug of FIG. 7.
Figure 10:
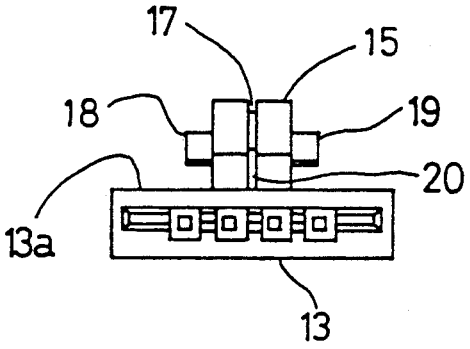
FIG. 10 is a bottom plan view of the connector plug of FIG. 7.
Figure 11:
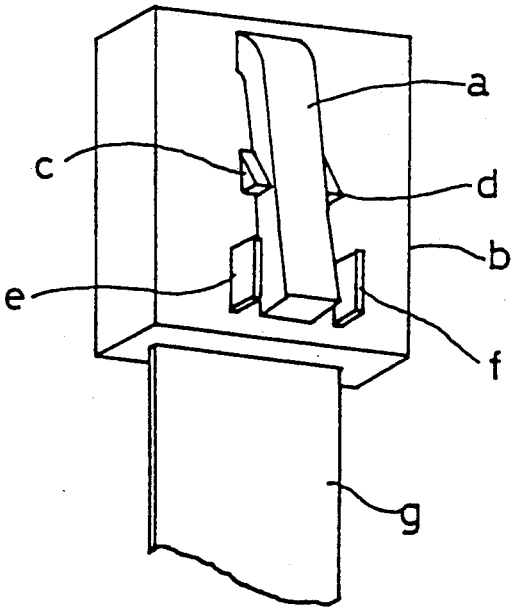
FIG. 11 PRIOR ART
FIG. 11 is a front elevational view of a conventional connector plug.

In operation, as FIG. 6 shows, the connector socket 2 is mounted on a board 23 by inserting the leg portions 11 of the terminals 9 into through holes 24 and soldering them. The connector plug 3 is fitted in the plug receiving opening 4 of the connector socket 2 so that the contact terminals 21 come into contact with the contact portions 10 of the terminals 9 for making electrical connection.

When the connector plug 3 is fitted into the plug receiving opening 4, the lock arm 15 is fitted into the lock recess 5 through the lock arm receiving opening 6 so that the engaging projections 18 and 19 flex the lock arm 15 and then engage the engaging shoulders 7 and 8 for assuring the connection. The key member 20 prevents the cable 22 from being caught between the lock arm 15 and the front surface 13*a* of the plug block 13.

As has been described above, the lock mechanism according to the invention includes a lock arm having a slit in its free end and a key member extending into the slit from the front surface of the plug block so that the number of key members decreases from two to one. In addition, since the key member is placed in the slit, the structure of a plug receiving opening is made simple and compact.

We claim:

1. An electrical connector structure comprising:

a connector socket having a plug receiving opening and a lock recess;

a connector plug having a plug block to be fitted into said plug receiving opening for making electrical connection;

a lock mechanism provided on a front surface of said connector plug for engagement with said lock recess for assuring said connection;

extending downwardly from an upper central portion of said front surface and having a free end with a slit extending between front and rear faces of said free end; and a key member extending into said slit from a lower central portion of said front surface of said plug block.

2. An electrical connector structure comprising:

a connector socket having a plug receiving opening and a lock recess;

a connector plug having a plug block to be fitted into said plug receiving opening for making electrical connection;

a lock mechanism provided on a front surface of said connector plug for engagement with said lock recess for assuring said connection;

said lock mechanism including a lock arm with a free end having a slit;

a key member extending into said slit from said front surface of said plug block; and said lock recess having a lock arm recess and a pair of engaging shoulders across said lock arm recess for engagement with engaging projections on said lock arm, thereby assuring said connection.

* * * * *